US005983530A

United States Patent [19]

Chou

[11] Patent Number: 5,983,530

[45] Date of Patent: Nov. 16, 1999

[54] SHOES WITH AUTOMATIC SHOESTRING TYING/UNTYING MECHANISM

[76] Inventor: Lung Chiao Chou, No. 1, Alley 9, Lane 250, sec 2, Cheng Gung RD., Nei Hu Area., China

[21] Appl. No.: 09/110,675

[22] Filed: Jul. 7, 1998

[30] Foreign Application Priority Data

Jul. 8, 1997 [CN] China ..... 97106505

[51] Int. Cl.[6] ..... A43C 11/12; A43B 3/26; A43B 3/24

[52] U.S. Cl. ..... 36/50.1; 36/50.5; 36/118.1

[58] Field of Search ..... 36/118.1, 50.1, 36/50.5

[56] References Cited

U.S. PATENT DOCUMENTS 5,026,087 6/1991 Wulf et al. ..... 36/118.1
5,175,949 1/1993 Seidel ..... 36/118.1
5,791,068 8/1998 Bernier et al. ..... 36/50.1
5,839,210 11/1998 Bernier et al. ..... 36/50.1

*Primary Examiner*—Paul T. Sewell
*Assistant Examiner*—Anthony Stashick
*Attorney, Agent, or Firm*—Dougherty & Troxell

[57] ABSTRACT

This invention relates to shoes with an automatic shoestring tying/untying device, and particularly to an automatic shoestring tying or untying device which is synchronous with wearing/taking-off action, and in which the tightness is adjustable. The device has a tying mechanism, slidable action and adjustment mechanism in the sole space, and shoestrings are inserted in the tying mechanism and extending through a shuttle piece and adjustment mechanism. The shuttle piece slides back and forth to let shoestring be tightened when wearing the shoes or to be automatically loosened in accordance with taking off the shoes. Adjustment of the arm adjusts the shuttle piece moving stroke to adjust the tightness of the shoestrings.

9 Claims, 7 Drawing Sheets

SHOES WITH AUTOMATIC SHOESTRING TYING/UNTYING MECHANISM

BACKGROUND OF THE INVENTION

Shoes are an essential product to every modern person. In order to make wearing comfortable and easy, manufacturers are working hard to present new products one after another not only in respect of fashion but also in respect to innovation relating to other functions. However, referring to a wearing/taking-off device, no improved design has been found, i.e. wearing/taking-off structure remains as tying shoestrings for wearing, shoestringfree wearing structure and zipper type wearing structure. Both of the latter are provided to solve the trouble arising from tying or untying shoestrings during wearing or taking off the shoes. For shoes with shoestrings, if it is desired to wear the shoes or take them off, one must tie up the shoestring for wearing, and has to untie it for taking off the shoes. Therefore, in order to avoid the trouble arising from tying and untying the shoestring, some consumers have chosen shoes without shoestring or with a zipper. There are other people who intend to avoid the trouble arising from wearing/taking off shoes, and thus they have not tightly tied up the shoestring to allow their feet to be inserted directly into the shoes or they may take off the shoes by raising their feet from the expansive mouth of the shoes. Nevertheless, in such a tying manner, the shoes would swing up and down following the feet moving forward resulting in deformation and damage of the shoe body. There is also known a winding assembly mounted on the vamp with a flexible false shoestring, whereby its flexibility can expand the shoes mouth to facilitate taking the shoe off. However, after using several times, its flexibility will become fatigued and cause discomfort.

SUMMARY OF THE INVENTION

One object of this invention is to overcome the shortcoming of shoes in general, and to provide an improved wearing/taking-off structure with at least one shoestring, and its characteristics further include an automatic shoestring tying and untying device, wherein:

a. shoe body: the sole has an operating chamber, and the internal side of an eyelet on the vamp which has a tension rope path. The operating chamber has an automatic shoestring tying/untying device. The shoestring enters the shoe body by virtue of the tension rope path and is tied on the automatic shoestring tying/untying device;

b. shoestring: consists of a hollow string and a tension rope extending through it, two ends of said tension rope extend from the tension rope path on the vamp to the sole, and to the automatic shoestring automatic tying/untying device;

c. automatic shoestring tying/untying device consists of:

a tying mechanism, said mechanism having two corresponding spaced tying pieces, fixed to the bottom of the operating chamber on the sole, with at least one through hole in the side ends of the two tying pieces;

an acting and adjusting mechanism including a shuttle piece, slidably mounted in the operating chamber between the two spaced tying pieces of the tying assembly mechanism, a side end of said shuttle piece extending through a tension slot, and the shoestring tension rope, after extending through the through hole of the tying piece, extends through said tension slot in a parallel manner. When said shuttle piece slides forward, each tension rope is pulled inward, thus tying up the vamp. The upper end of said shuttle piece has at least one retaining slot, engaged by an arm. Said arm may be adjustable for adjusting the shoestring tension length to adapt to different foot widths. Said arm consists of a movable assembly of two arm rods, with the distal end of one arm rod in the selective retaining slot and an end of another arm rod fixed into the internal side of the sole;

a clamp having a length corresponding to the inner sole is mounted on the sole under the shank and available for lifting up, a distal end of the bottom of said clamp having an insertion member, the distal end of said insertion member having a retaining head, when the insertion member is pressed in the inner end of the sole by the clamp, said retaining head is retained by a control mechanism mounted in the sole;

at least one spring mounted between the bottom end of said clamp and an upper end of a tension piece of the tying assembly mechanism, such that when it is pressed by the clamp it stores spring energy to untie the shoestring for taking off the shoes;

a control mechanism including a push bottom with a water-proof hood and mounted in the rear side of sole or heel, the inner end of said push button having a retaining piece, said retaining piece having two thrust arms pushing against the inner end of the push button, and another end extending to form a shaft post, said shaft post having a spring constantly thrusting against the push button moving direction, and having a shorter retaining control part between two thrust arms of said retaining piece, whereby, by pushing down the push button, the retaining control is thus released enabling the wearer to take off the shoes.

DETAILED DESCRIPTION OF THE PREFERRED EMBODIMENT

Figure 1:
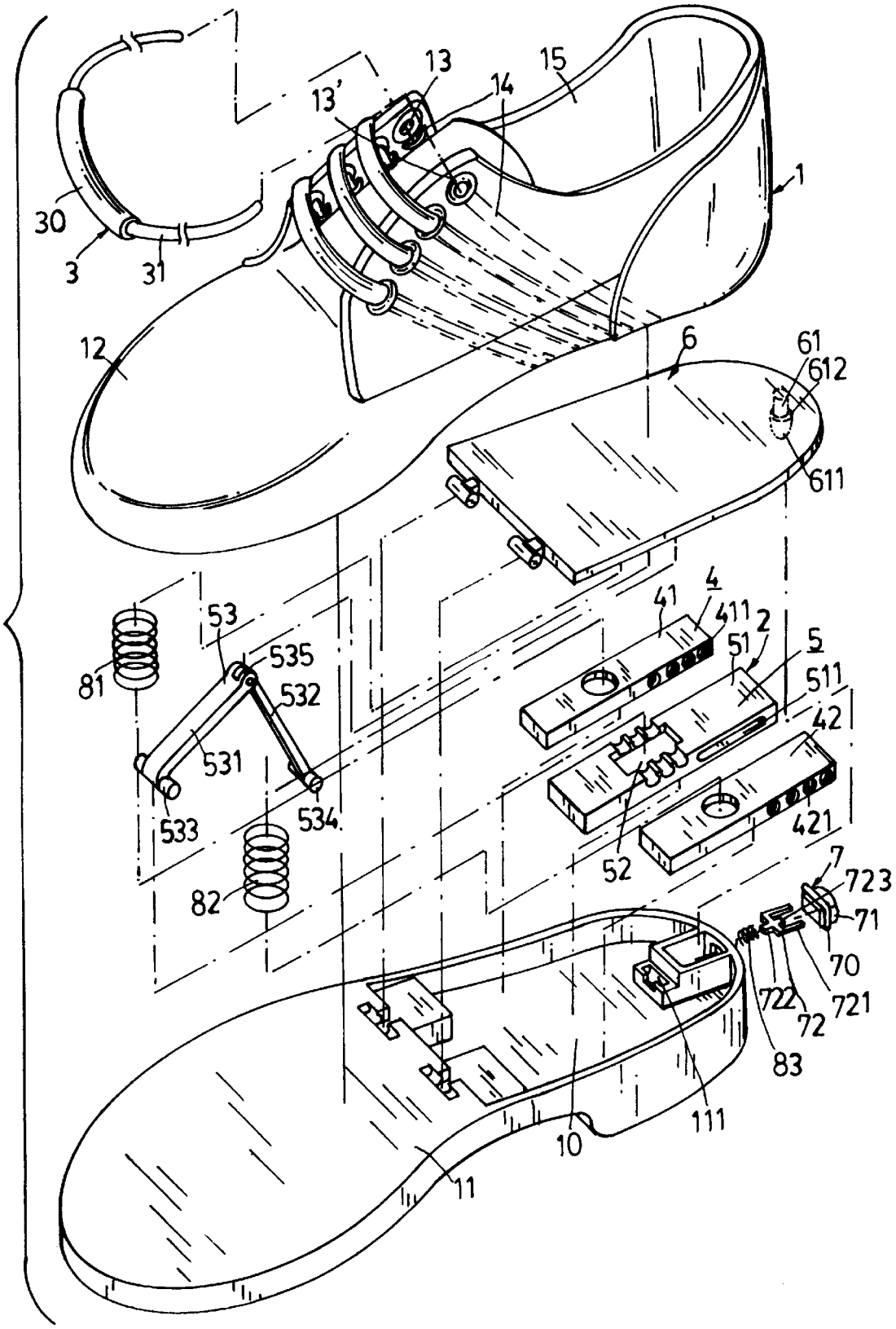
FIG. 1 is an exploded perspective view of the present invention.

Referring to FIG. 1, the automatic shoestring tying/untying mechanism of this invention is mounted in an operating chamber 10 formed in the sole 11 of the shoe 1. The shoe 1 includes a tension rope path 14 from the eyelet 13 of the vamp 12. The automatic shoestring tying/untying mechanism 2 comprises at least one shoestring 3, one tying assembly mechanism 4, an action and adjustment mechanism 5, a clamp 6, a control mechanism 7 and spring element. The shoestrings 3 extend through opposite eyelets 13, in a mutually parallel manner. Said shoestrings consist of hollow decorative strings 30 through which extend tension ropes 31. The length of said decorative string 30 corresponds to the length of the shoestring extending through the eyelets 13. The tension rope 31 extends from both sides of decorative string 30 to the operating chamber 10 on the sole 11 through the tension rope path 14. The tension ropes 31 extend through the tying pieces 41, 42 of the tying assembly structure 4 and the rope guiding slot 511 of the shuttle piece 51 of the action and adjustment mechanism 5. Thus the distal ends of each rope 31 are connected together and the tension ropes are tensioned by the sliding of shuttle piece 51 of action and adjustment mechanism.

Figure 4:
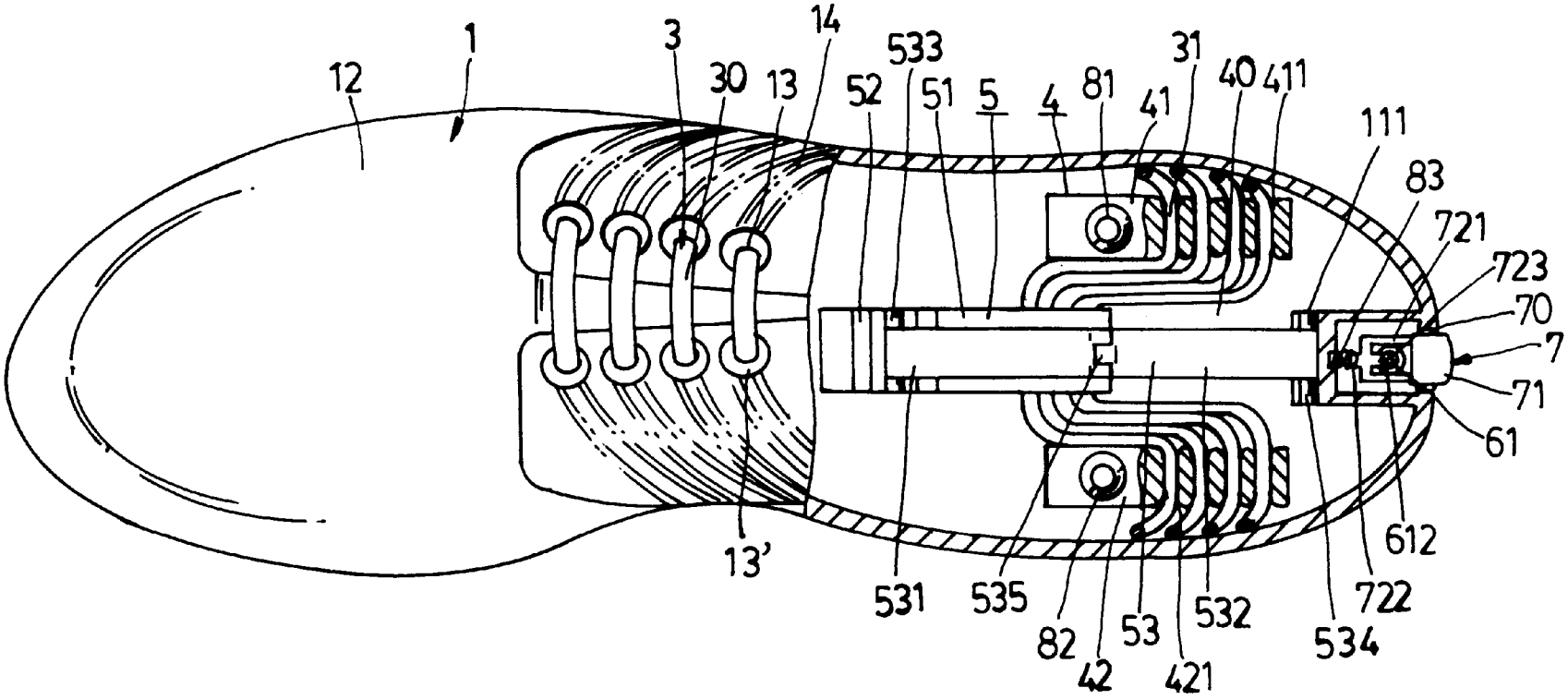
FIG. 4 is a top view of the shoe illustrated in FIG. 3.
Figure 9:
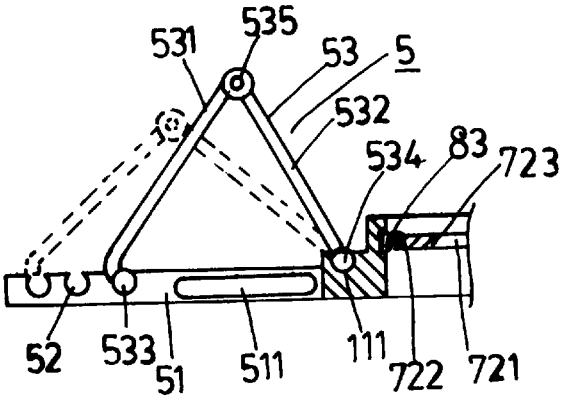
FIG. 9 is a side view showing the adjustment of the curved arm of the adjustment mechanism of the shoe according to this invention.

Referring to FIG. 4, the tying assembly mechanism 4 comprises two spaced tying pieces 41, 42, with a space 40 formed between the two tying pieces 41, 42, located on the bottom of operating chamber 10 on the sole 12. The two tying pieces 41, 42 have at least two through holes 411, 421. In this embodiment, the number of through holes 411, 421 correspond to the number of shoestring tension ropes 41 which extend through the through holes 411, 421. Said action and adjustment mechanism 5 has a shuttle piece 51 which is slidably mounted in the space 40 between the two tying pieces 41, 42. A side end of the shuttle piece 51 has a rope guiding slot 511 provided for tension ropes 31 of each shoestring 3 to extend through after passing through holes 411, 421 in a parallel manner. As shuttle piece moves forward, each tension rope 31 is tensioned in sequence, and the shoestrings 3 are pulled tight inwardly to tie the vamp tightly. The upper end of the shuttle piece 51 has at least one retaining slot 52 provided for retaining the arm 53 in different retaining positions to change the height of the arm 53 and sliding length of the shuttle piece 51 (FIG. 9) to change the inward-tensioned length of the shoestring 3 and therefore to change the tightness of the shoe. The setting and adjustment can be determined subject to feet size of the user, and regardless of the user's feet width, proper tightness can be achieved. Said arm 53 comprises of two arm rods 531, 532 movably attached by means of a shaft assembly. A distal end of arm rod 531 forts a retaining rod 533 provided for engaging one of the retaining slots 52. The distal end of arm rod 532 forms a shaft rod 534 engaging the shaft retaining slot 11 at the rear side of operating chamber 10. The shaft end 535 connecting the two arm rods 531, 532 is attached to the bottom end of the clamp 6.

Figure 2:
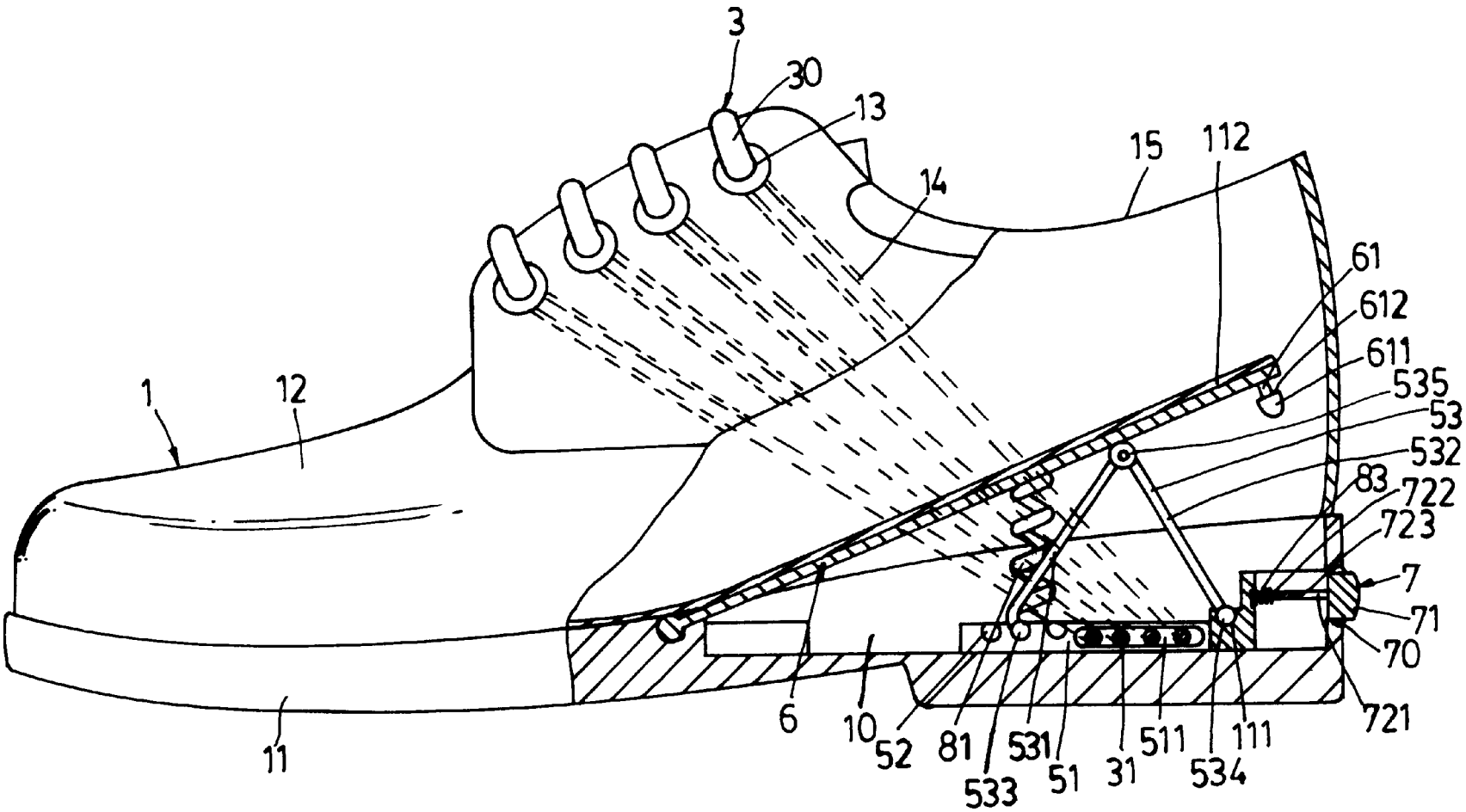
FIG. 2 is a side view, partially broken away showing the shoe of this invention not being worn.

Referring to FIG. 2, clamp 6 forms a shank 112 of the sole and can be lifted up by spring 81, 82. The bottom of the clamp 6 has an insertion member 61, forming a fastening head 611. Said fastening head 611 has retaining control shoulder 612, such that, when the clamp 6 is pressed flat on the sole 11, said fastening head 611 is inserted into the control mechanism 7 within the sole 11.

Figure 5:
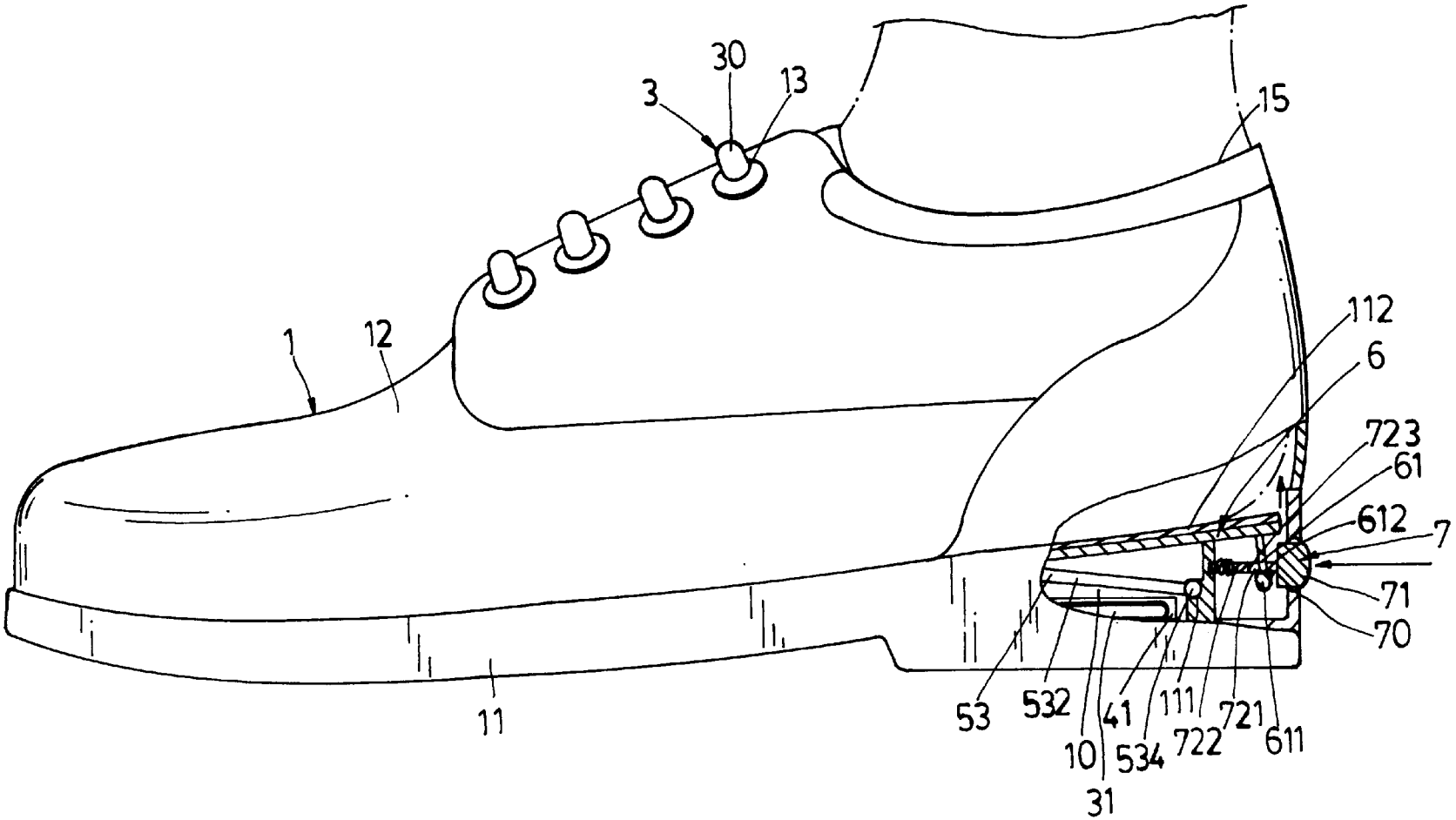
FIG. 5 is a side view, partially broken away showing the taking-off of the shoes according to this invention.

Referring to FIGS. 1, 3, 4 and 5, said control mechanism 7 includes a push button 71 with a waterproof hood 70 mounted in the rear side of the sole 11 or the heel. The inner side of push button 71 has an extending fastening piece 72, with two thrust arms 721 to thrust on the inner end of push button 71, and another end with a shaft post 722 engaging a spring 83 to push toward the push button 71. A shorter retaining portion 723 lies between the two thrust arms 721. When the shoes are worn by the user, the clamp 6 is pressed down with the shoulder 612 of fastening head 611 engaged by the retaining portion 723 (FIG. 3) which also causes the springs 81, 82 to store energy by compressing. Pushing the push button 71 will push the fastening piece 72 to release fastening control from the insertion member 61 (FIG. 5). When the shoes are taken off, springs 81, 82 thrust the clamp 6 upward. There is a pull-up force on the shoestrings 3 from the feet, which causes the shuttle piece 51 to be pulled backward. Thus, the shoestrings 3 are untied for taking off the shoes.

Figure 3:
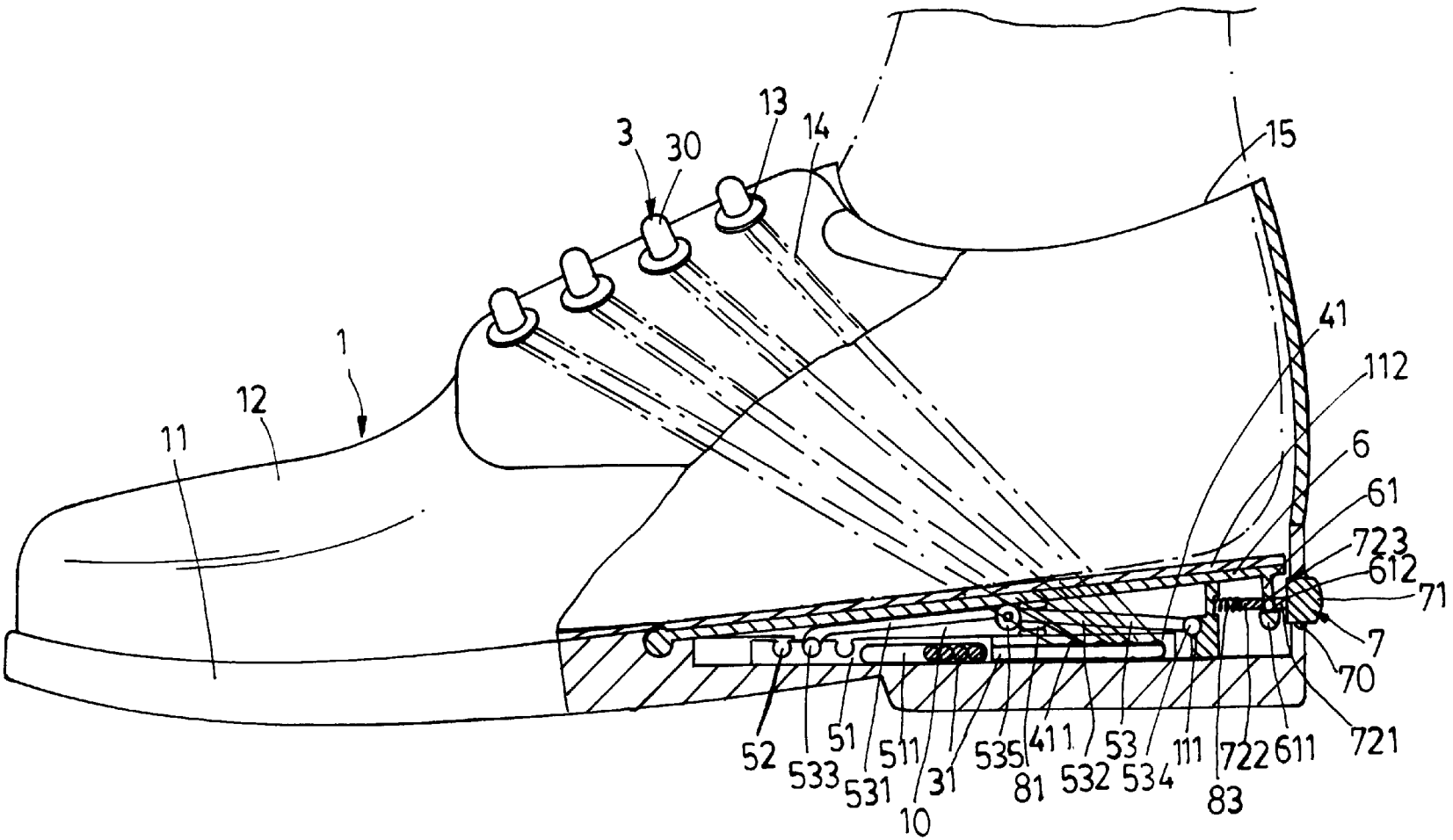
FIG. 3 is a side view, partially broken away showing the shoe of this invention during wearing.

Referring to FIG. 2 thru 5, when the shoes are not worn, the clamp 6 lifts up the arm 53 and the shuttle piece 51 is located at an original untied position without pulling the shoestrings (FIG. 3). When the user desires to wear the shoes, he just needs to step into the shoes through the shoe mouth 15, and the foot bottom engages the clamp 6, and said clamp 6 will be pressed flat. This causes the arm 53 to move downward (FIG. 3), and to displace the shuttle piece 51 forward. During such displacement, the rope guiding slot 511 of shuttle piece 51 gradually pulls the tension ropes 31 of each shoestring in sequence synchronously so that the shoestrings 3 are pulled toward the shoe body 1. When the arm 53 is under expansion and reaches a flat condition, i.e. when shuttle piece 51 forward stroke is stopped (FIG. 3, 4), the shoestrings 3 are pulled inward to form a tied state, with the vamp 12 covering the instep. At this moment the fastening head 611 is inserted between the two thrust arms 721 of the control mechanism 7 and fastened on the shoulder 612 by means of the thrust control portion 723. The clamp 6 is prevented from lifting up under the influence of moving forward or walking. The springs 81, 82 are compressed so as to store necessary energy for the untying process. When it is desiring to take off the shoes, the user pushes the push button 71 of control mechanism 7 inwardly (FIG. 5), to move the fastening piece 72 inward and release control from the insertion member 61. As the foot is pulled out of the shoe mouth 15, and springs 81, 82 push the clamp 6 up. The force of pulling the foot up will cause vamp covering to be pulled open, and the shoestrings 3 to be pulled out of the shoes body 1, which displaces the shuttle piece 51 back to the original position.

Figure 6:
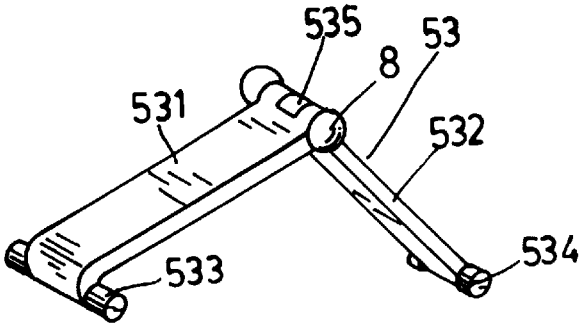
FIG. 6 is a perspective view showing a structure of the curved arm of the adjustment mechanism of the shoe according to this invention.
Figure 7:
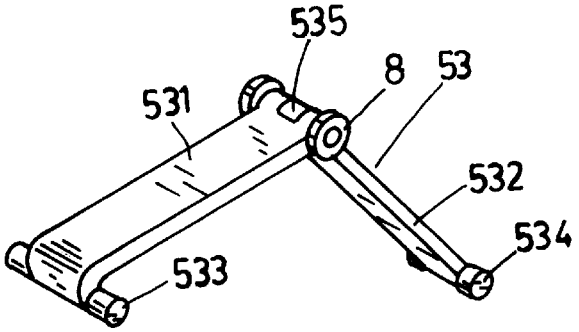
FIG. 7 is a perspective view showing an alternative structure of the curved arm of the adjustment mechanism of the shoe according to this invention.

Referring to FIGS. 6 and 7, the ends of shaft 535 may be directly mounted with a sliding member 8. Said sliding member 8 may be an integrally molded piece, with a smooth and round body (FIG. 6) or a pulley (FIG. 7) so as to push against the bottom of the clamp 6, to enable the clamp 6 to move smoothly.

Figure 8:
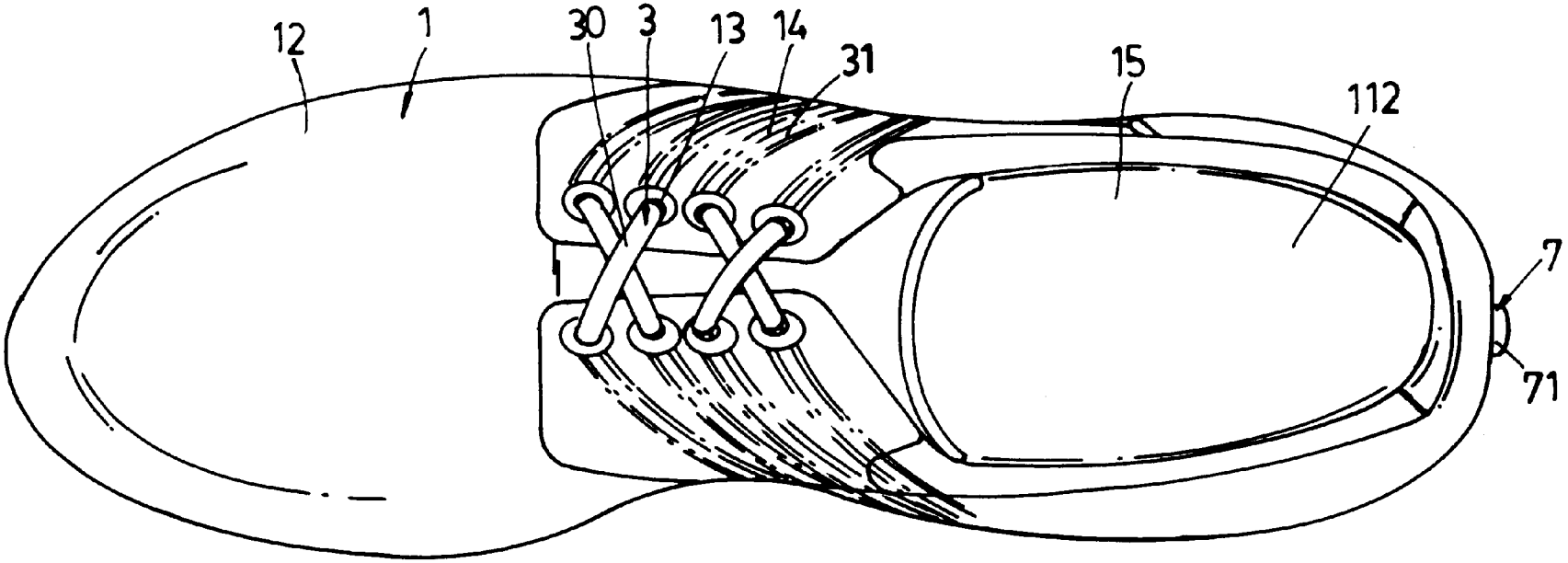
FIG. 8 is a top view showing another way of lacing the shoestring according to this invention.

The mounting of shoestrings 3 is not to be limited to the parallel mounting type as shown on the embodiment of FIG. 1. They can also be mounted in a cross manner (FIG. 8) or the number of shoestrings can be less than the number of eyelets 13. A false shoestring can be mounted at a lowest eyelet, and a shoestring 3 directly mounted at a middle eyelet and at a topmost eyelet.

I claim:

1. A shoe with an automatic tying/untying mechanism comprising:

a) a shoe body having a sole and a vamp with a plurality of eyelets, an inner, rear portion of the sole having an operating chamber, the vamp having at least one tension rope path communication with at least one eyelet and the operating chamber;

b) two spaced apart tying pieces fixedly located in the operating chamber;

c) a shuttle piece movably located in the operating chamber between the spaced apart tying pieces;

d) a clamp pivotally connected to the sole and located within the shoe body, the clamp being movable between an initial position and a wearing position;

e) an arm mechanism acting on the clamp and connected to the shuttle piece such that movement of the clamp between the initial and wearing positions moves the shuttle piece between untied and tied positions;

f) a latch mechanism releasably engageable with the clamp to releasably hold the clamp in the wearing position; and, g) at least one shoestring passing through at least one eyelet, the at least one tension rope path, at least one of the two spaced apart tying pieces and the shuttle piece whereby movement of the shuttle piece away from the untied position tightens the at least one shoestring and movement of the shuttle piece away from the tied position loosens the at least one shoestring.

2. The shoe according to claim 1 further comprising a plurality of notches on the shuttle piece wherein the arm mechanism is releasably engageable with each of the plurality of notches to adjust the location of the shuttle piece in the tied position.

3. The shoe according to claim 1 further comprising at least one spring acting on the clamp to bias the clamp toward the initial position.

4. The shoe according to claim 1 further comprising a plurality of eyelets and wherein the at least one shoestring comprises a tension rope movable by the shuttle piece and a decorative element extending between two of the plurality of eyelets through which the tension rope passes.

5. The shoe according to claim 1 wherein the arm mechanism comprises:

a) a first arm rod having a first end pivotally connected to the sole in the operating chamber and a second end; and, b) a second arm rod having a first end pivotally connected to the second end of the first arm and a second end connected to the shuttle piece.

6. The shoe according to claim 5 wherein the arm mechanism acts on the clamp at the juncture of the first and second arm rods.

7. The shoe according to claim 1 wherein the latch mechanism comprises:

a) a movable button located in the sole having a portion extending into the operating chamber with a fastening piece, the button being movable between a latched position and a released position; and, b) an insertion member extending from the clamp and located so as to engage the fastening piece when the clamp is in the wearing position and the button is in the latched position, whereby movement of the button to the released position disengages the fastening piece and the insertion member.

8. The shoe according to claim 7 further comprising a spring acting on the movable button to bias the button toward the latched position.

9. The shoe according to claim 7 further comprising a waterproof hood mounted around the movable button.

* * * * *